US006889860B2

(12) United States Patent
Mazzarolo

(10) Patent No.: US 6,889,860 B2
(45) Date of Patent: May 10, 2005

(54) PLASTIC DRINK-THROUGH CUP LID WITH FOLD-BACK TAB

(75) Inventor: Ivonis M. Mazzarolo, Vaudreuil (CA)

(73) Assignee: M & N Plastics, Inc., Plant City, FL (US)

( * ) Notice: Subject to any disclaimer, the term of this patent is extended or adjusted under 35 U.S.C. 154(b) by 0 days.

(21) Appl. No.: 10/427,291

(22) Filed: May 1, 2003

(65) Prior Publication Data

US 2003/0192890 A1 Oct. 16, 2003

Related U.S. Application Data

(63) Continuation of application No. 09/952,144, filed on Sep. 14, 2001.

(51) Int. Cl.[7] ..... B65D 51/18
(52) U.S. Cl. ..... 220/254.3; 220/712
(58) Field of Search ..... 220/254.3, 254.1, 220/254.5, 268, 711, 712, 716, 780; 229/404, 906.1

(56) References Cited

U.S. PATENT DOCUMENTS

| | | | |
|---|---|---|---|
| 2,003,657 | A | 6/1953 | Stubblefield |
| 2,661,889 | A | 12/1953 | Phinney |
| 3,362,569 | A | 1/1968 | Geiger |
| 3,447,710 | A | 6/1969 | Blair |
| 3,800,999 | A | 4/1974 | Serritella |
| 3,860,162 | A | 1/1975 | Schutz |
| 3,868,043 | A | 2/1975 | Freemyer |
| 3,927,794 | A | 12/1975 | Erdman |
| 3,933,264 | A | 1/1976 | Rossi |
| 4,056,210 | A | 11/1977 | Boyle |
| 4,081,103 | A | 3/1978 | Zoellick |
| 4,106,660 | A | 8/1978 | Boyle |
| 4,138,033 | A | 2/1979 | Payne et al. |
| 4,184,604 | A | 1/1980 | Amberg et al. |
| 4,187,954 | A | 2/1980 | Striggow |
| 4,190,174 | A | 2/1980 | Halmowitz |
| 4,202,459 | A | 5/1980 | DeParales et al. |
| 4,210,256 | A | 7/1980 | Amberg et al. |
| 4,215,793 | A | 8/1980 | Packard |
| 4,253,582 | A | 3/1981 | Shields |
| 4,331,255 | A | 5/1982 | Fournier |
| 4,345,695 | A | 8/1982 | Galloway et al. |
| 4,350,260 | A | 9/1982 | Prueher |
| 4,361,249 | A | 11/1982 | Tuneski et al. |
| 4,438,865 | A | 3/1984 | Scattaregia |
| 4,460,103 | A | 7/1984 | Rama et al. |
| 4,489,848 | A | 12/1984 | Braude |
| 4,502,608 | A | 3/1985 | Mills |
| 4,503,992 | A | 3/1985 | Sitko et al. |
| 4,518,096 | A | 5/1985 | Womstead |
| 4,537,326 | A | 8/1985 | Morehead |
| 4,579,245 | A | 4/1986 | Narushko |
| 4,582,214 | A | 4/1986 | Dart et al. |
| 4,589,569 | A | 5/1986 | Clements |
| 4,615,459 | A | 10/1986 | Clements |
| 4,629,088 | A | 12/1986 | Durgin |
| 4,738,373 | A | 4/1988 | DeParales |
| 4,741,450 | A | 5/1988 | Braude |
| 4,796,774 | A | 1/1989 | Nabinger |
| 4,898,299 | A | 2/1990 | Herbst et al. |

(Continued)

*Primary Examiner*—Joseph C. Merek
(74) *Attorney, Agent, or Firm*—Young & Basile, P.C.

(57) ABSTRACT

A plastic drink-through lid of the type having a deck, a peripheral skirt, and a partially separable, preformed tab in the deck to form a drink-through hold which does not extend through the peripheral skirt. The tab has an upstanding thumb catch preformed thereon. The fold back hinge is formed in the deck immediately adjacent the tab and spaced less than about one-half of the lid radius from the periphery. This creates a very short throw which allows a user to open the tab and lock it back with the thumb of the same hand that is holding the cup.

7 Claims, 4 Drawing Sheets

U.S. PATENT DOCUMENTS 4,949,865 A 8/1990 Turner
5,090,584 A 2/1992 Roberts et al.
5,111,961 A 5/1992 Van Melle
5,197,624 A 3/1993 Dodarao
5,335,812 A 8/1994 Boller
5,348,181 A 9/1994 Smith et al.
5,398,843 A 3/1995 Warden et al.
5,490,609 A 2/1996 Lane et al.
5,509,568 A 4/1996 Warden et al.
5,613,619 A 3/1997 Van Melle
5,699,927 A 12/1997 Lane et al.
5,839,601 A 11/1998 Van Melle
6,079,588 A 6/2000 Khafizov
6,089,397 A 7/2000 Van Melle
6,260,727 B1 7/2001 Durdon
6,612,456 B1 9/2003 Hundley et al.

FIG - 1
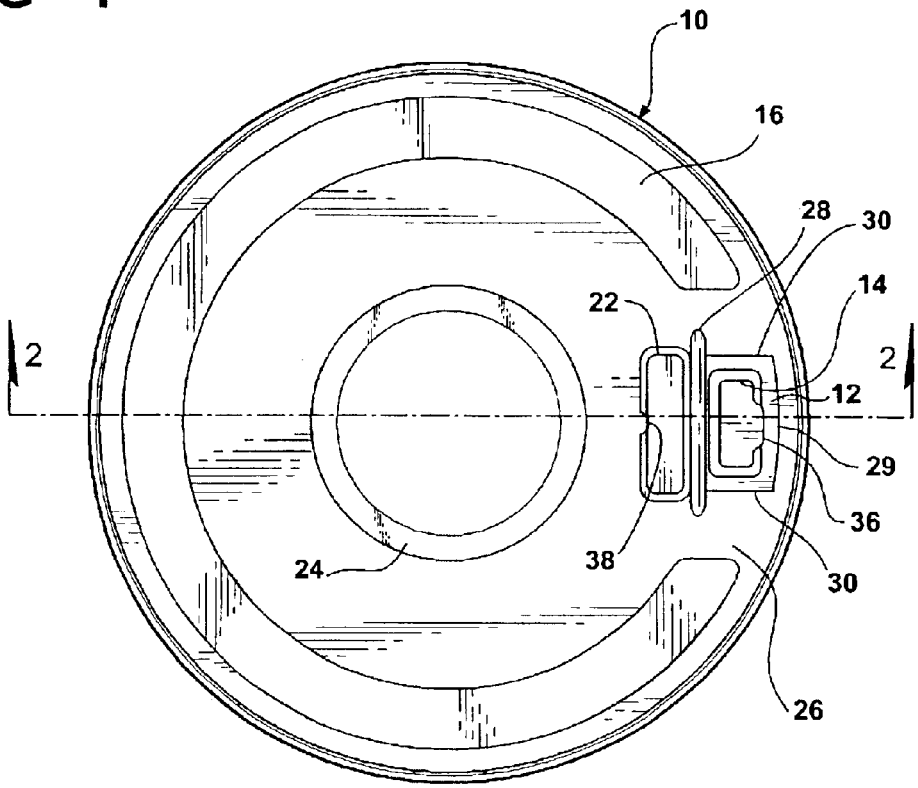
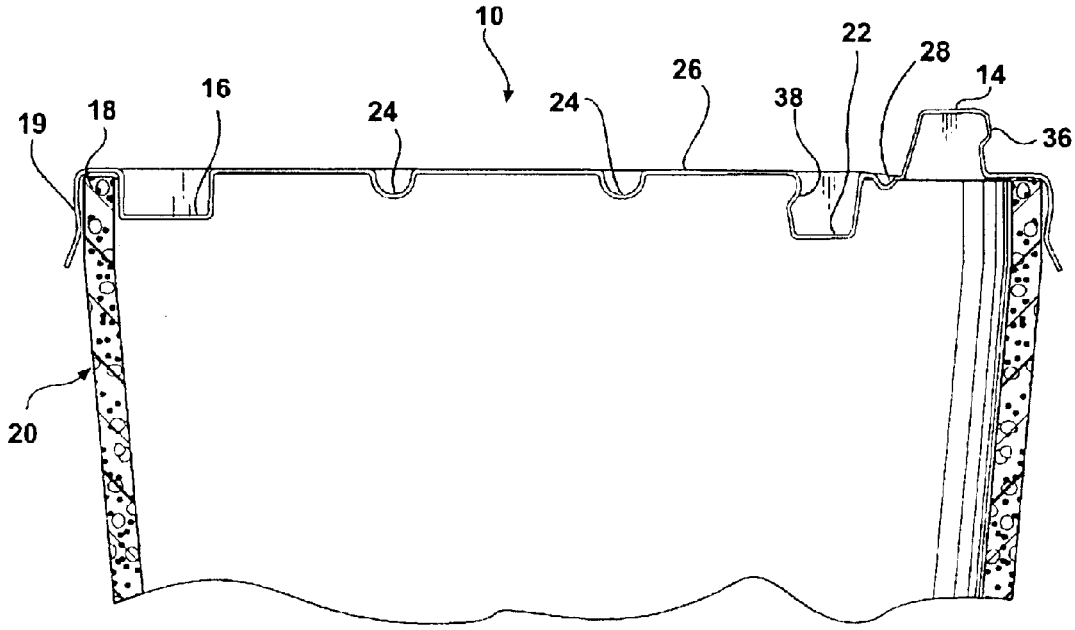
FIG - 2

FIG - 3
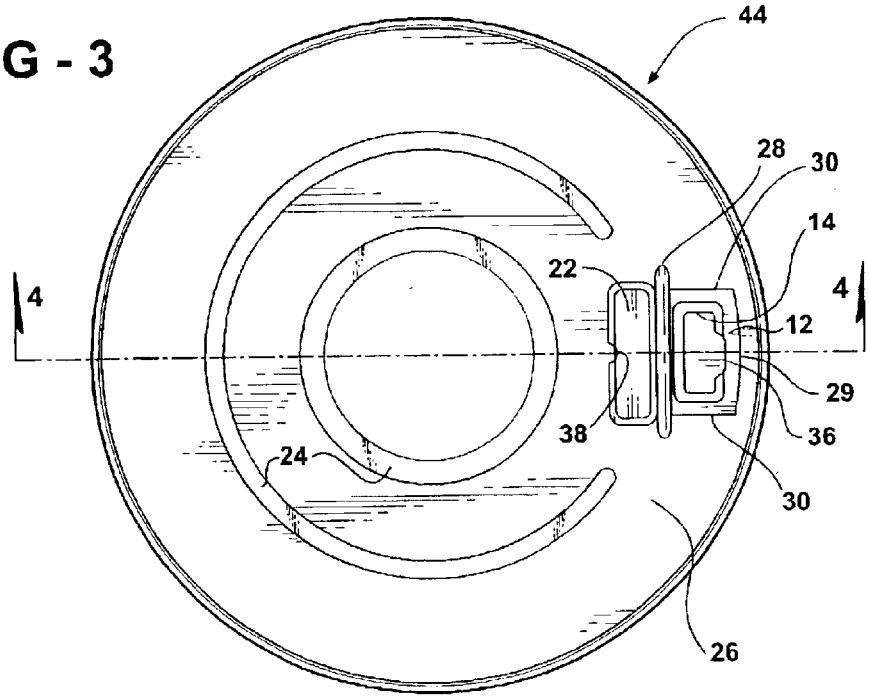
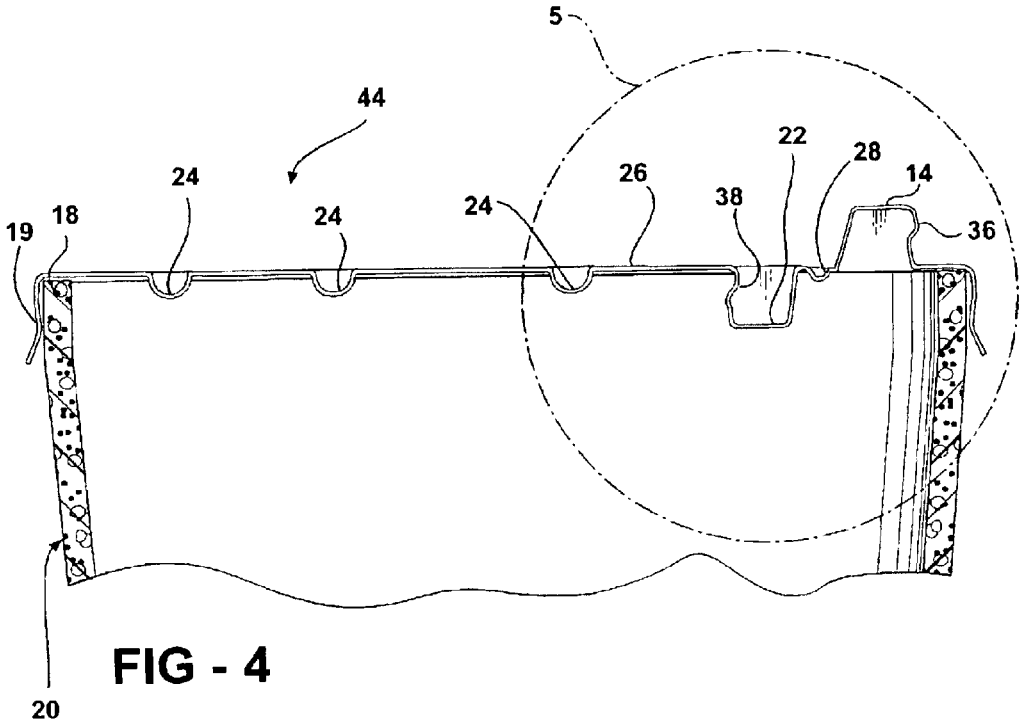
FIG - 4

FIG - 5
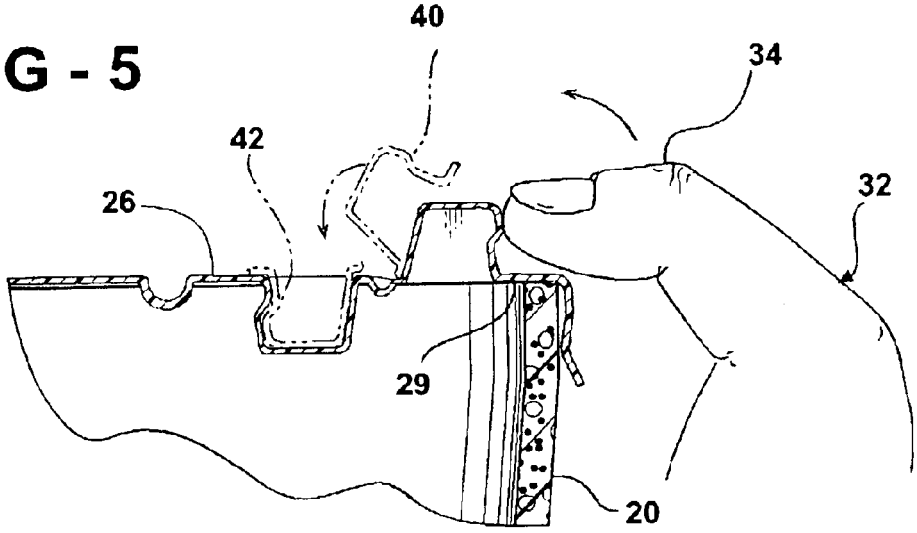
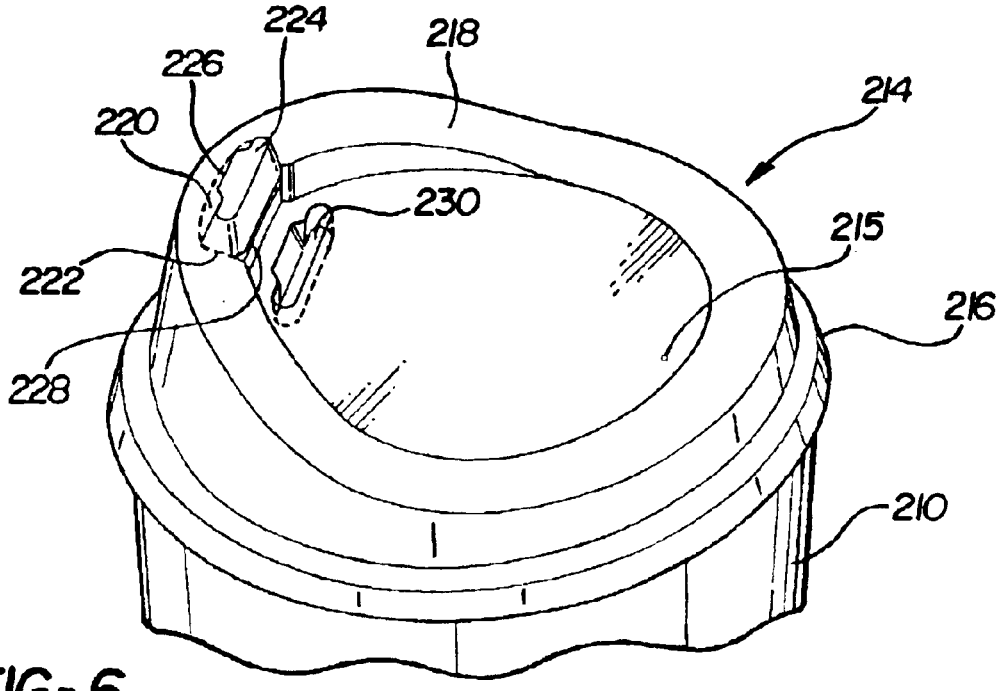
FIG-6

PLASTIC DRINK-THROUGH CUP LID WITH FOLD-BACK TAB

CROSS-REFERENCE TO RELATED APPLICATION

This application is a continuation of U.S. Ser. No. 09/952,144, filed Sep. 14, 2001, and claims priority thereto.

FIELD OF THE INVENTION

The present invention is in the field of molded plastic cup lids with a drink-through feature opened by a fold back tab.

BACKGROUND OF THE INVENTION

Plastic molded disposable cup lids with a drink-through feature are widely used in combination with disposable cups in retail sales of coffee, tea, cocoa and other drinks. Many such lids have an integral fold-back tab which allows a user to leave the lid closed until ready to consume the product contents. The user then breaks the fold-back tab free and folds it back to a locked position wherein a raised feature on the tab fits into a recess on the opposite side of the lid. Examples of such lids are found in the patents to Lombardi U.S. Pat. No. 3,977,559; DeParales U.S. Pat. No. 4,738,373 and Roberts et al. U.S. Pat. No. 5,090,584.

Most of such lids have fold-back tabs in which the distance from the periphery of the lid to the hinge is more than half of the lid radius and, in some cases, nearly a full radius. This requires the lock-back recess to be placed on the opposite side of the lid center such that the tab must extend, when folded, nearly all the way across the lid. It takes two hands to release, fold-back, and lock such a tab. This is particularly true of the Roberts et. al. and DeParales lids in which the tab extends through the rim of the lid.

To eliminate the inconvenience of such lids, some manufacturers have gone to lid designs having a pre-formed, small hole which is always open or to a flap which hinges downwardly into the cup interior when pressed by the upper lip of the user.

SUMMARY OF THE INVENTION

The present invention provides a plastic lid with a fold-back, lock-back drink-through tab which securely seals the drink-through opening until used, but is easily operated with one hand. In general, this is accomplished by providing a normally closed, partially cut-through tab which is near, but does not extend through, the peripheral skirt of the lid, and which folds back around a hinge which is not only a short distance from the periphery but also immediately between the tab and a lock-back recess such that the total folding movement of the tab is very short. A raised catch is formed on the tab between the hinge and the peripheral edge so as to be easily engaged on the outside surface by an adult thumb when it is desired to break the tab free and fold it back. Accordingly, the folded tab generally lies entirely on the near side of the lid center when folded back, and it is easy for an adult to use his or her thumb to break the tab free and lock it back with one hand in one continuous motion. There is normally no need to grasp the raised catch between finger and thumb; rather the breaking, folding and locking actions can all be performed by the thumb of the hand holding the cup.

One or more horizontal ridges are preferably formed on the upper, outside surface of the thumb catch so as to enable the thumb to more readily engage the protrusion and push the tab up and back. This ridge may also used to releasably lock the thumb catch into the lock-back recess when in the fully open, folded back position by frictionally engaging a second, complemental ridge on the far wall of the recess.

The short-throw, fold-back tab and locking recess described above may be used with a variety of lid types, including plug-fit lids and outside fit lids.

BRIEF DESCRIPTION OF THE DRAWINGS

FIG. 1 is a plan view of a first lid embodying the present invention;

FIG. 2 is a cross-sectional view of the lid of FIG. 1 taken along a diameter running through the fold-back tab;

FIG. 3 is a plan view of a second lid embodying the invention;

FIG. 4 is a cross-sectional view of the FIG. 3 lid through the fold-back tab;

FIG. 5 is a detailed cross-sectional view of the fold-back tabs of FIGS. 2 and 4 showing the manner of using same;

FIG. 6 is a perspective view of a "cappuccino style" cup lid with the short-throw, fold-back tab attached to the rim of a cup;

DESCRIPTION OF THE ILLUSTRATIVE EMBODIMENTS

Figure 7:
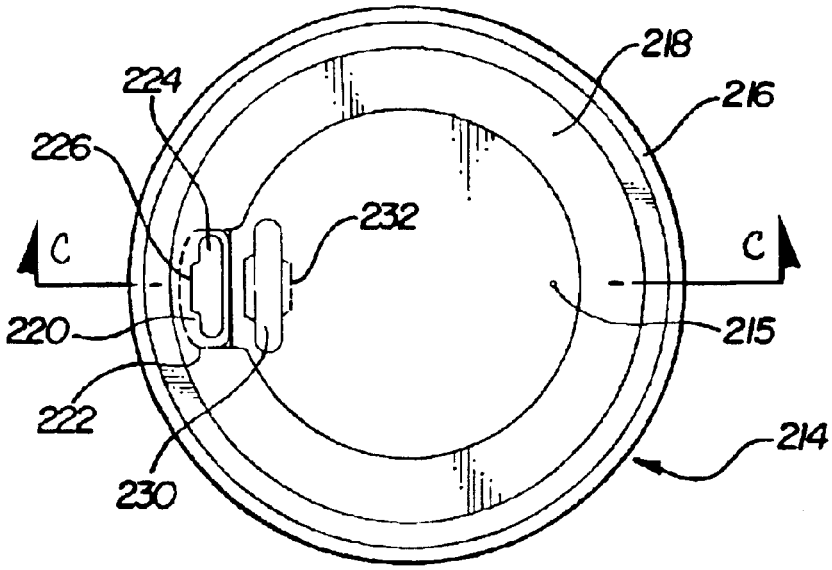
FIG. 7 is a top view of the lid depicted in FIG. 6.

Referring to FIGS. 1, 2 and 5, a thermoformed lid 10 is shown to have a partially die-cut tab 12 with an upstanding thumb catch 14 formed thereon. The tab is formed in a flat deck 26 set in from the periphery approximately ⅛ inch as shown in FIG. 1. The tab 12 operates in conjunction with a molded-in hinge 28 and a lock-back recess 22 which are immediately adjacent one another; i.e., there is essentially little or no radial spacing between hinge 28 and each of the tab 12 and recess 22 as opposed to prior art devices in which the radial spacing between hinge and lock-back feature can be from ¼ inch to nearly one-half the lid radius. The lid 10 is designed to provide a plug fit on a conventional Styrofoam drink cup 20 approximately three inches in diameter. The lid may be used with beaded or rolled rim paper cups as well. The plug fit is created by a molded-in C-shaped depression 16 in deck 26 the outer wall of which is set in from the periphery of the lid by about its thickness of the cup wall. The depression projects below the rim of the cup 18 to provide an inverted U-shaped peripheral channel which receives the cup rim 18 therein. The lid has a flared peripheral skirt 19 which engages the outside wall of the cup 20 when installed thereon. Depression 16 defines an included angle of approximately 300°. Other structural and/or aesthetic features 24 may be molded into the deck 26 of the lid 10 as desired in areas that are not otherwise required for the fold-back tab 12. The catch 14 is higher than any part of the deck 26 including the portion which overlies the cup rim 18.

The tab 12, hinge 28 and locking recess 22 are situated in the deck 26. The tab 12 is formed by die cut lines 29 and 30 which are discontinuous so as to hold the tab 12 closed but easily fractured to allow the tab to be broken free under slight pressure. The hinge 28 lies about one-quarter of a radius from the periphery of the lid 10 and is immediately between the tab 12 and locking recess 22. The fold-over radius, or "throw" length, of the tab 12 is extremely short, i.e., on a lid of approximately 3½ inches in diameter, the hinge is about ⅝ inch from the near peripheral edge. These dimensions are intended to reflect proportions rather than size limitations.

The hinge 28 is preformed in the lid deck 26 in a shallow "U"-shape. The upstanding catch 14 is of generally rectangular shape and is created in the thermoforming operation along with the other details. The catch 14 is tall enough, i.e., about ¼ inch, to allow an ordinary user to readily engage its radially outermost surface with the thumb of the same hand that is holding the cup 34. The catch 14 has a horizontal ridge 36 formed along the top edge of the outer surface to allow the user to "flick" the catch 14 upwardly to break the tab 12 free from the lid deck 26 and fold it back in one easy motion. The recess 22 is shaped such that it will completely receive the catch 14 and hold it below the lid deck 26, with only a small amount of the tab material resting above the lid deck.

As mentioned, a small horizontal ridge 36 is preformed in the upper outside surface of the thumb catch 14. A second small horizontal ridge 38 is preformed in the upper portion of the central wall of the recess 22. Both ridges 36 and 38 are sized and located such that they will frictionally engage each other when the thumb catch 14 is in the fully folded position 42 to releaseably lock the thumb catch 14 in the folded-back position 42.

Referring now to FIGS. 3 through 5, a second embodiment of the invention is shown. In these Figures, elements identical to corresponding elements in FIGS. 1 and 2 are given the same reference numerals. A lid 44 is thermoformed from extruded sheet material to exhibit a top deck 26 adapted to overlie the open end of a conventional cup 18. Decorative structural features 24 are formed into the deck 26. Adjacent, but spaced slightly inwardly from the periphery of the lid, is a partially die cut tab 12 having a raised catch 14 which is ridged at 36 to provide engagement leverage as well as a lock-back action to be described. Again the catch 14 is higher than the deck 26. The rear of the tab 12 is uncut and terminates in a shallow hinge 28. The hinge lies directly between the tab 12 and a recess 22 into which the catch 14 fits when the tab 12 is folded back. A ridge 38 on the top rear wall of recess 22 locks with ridge 36 on the catch 14 to lock the tab 12 in the fold-back position. The lid 44 has a peripheral skirt 19 which engages the outside surface of the cup when applied thereto.

The lid 44 of FIGS. 3 and 4 has no plug fit; i.e., it is generally referred to as an "outside fit" and is typically used for cold drinks.

Operation of the FIGS. 1 and 3 lids is represented in FIG. 5. An ordinary adult user grasps the cup 20 in his or her right hand 32 with the thumb 34 near the top edge of the cup. The end of the thumb is used to push up on the thumb catch 14 to break the tab 12 free of the surrounding deck material. Further movement of the thumb is used to fold the tab back into the locking recess whereupon the user can drink through the opening created by the tab. After drinking, the tab 12 can be replaced to partially close the drink-through opening. Because the hinge 28 lies only about ½ inch inside the lid rim and the recess 22 is immediately adjacent the hinge, the "throw" for the fold back is very short and full folding and locking can typically be achieved with one hand.

Figure 8:
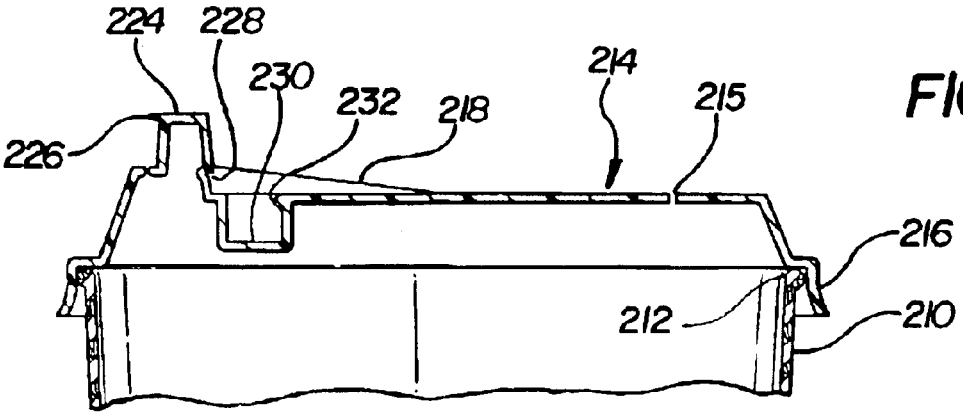
FIG. 8 is a section view of the lid depicted in FIG. 6 along the line C—C in FIG. 7.

FIGS. 6–8 illustrate a lid 214 designed for use with a cup 210 having a beaded rim 212 for marketing preimium drinks such as a cappuccino. Lid 214 is thermoformed from plastic sheet stock and die cut for removal from the sheet after the various features thereof are formed.

Lid 214 has a flared peripheral skirt 216 a flat circular inner deck 215 and an annular raised outer deck 218 approximately half of which ramps upwardly on the side in which a tab 220 is partially cut to form a drink through opening 226. The tab 220 is essentially rectangular and is formed by discontinuous die cuts 222 on the outer and side edges but left intact with the inner deck 215 along a hinge 228. An elevated catch 224 is formed on the tab 220 to enable the user to break the tab 220 free and fold it back toward the center of the lid until the catch 224 fits into a recess 230 formed in the deck 215. Again, catch 224 is the highest feature on the lid. Locking ridges 226 and 232 are formed in the catch 224 and recess 230, respectively, to lock the catch into the recess. As was the case with the embodiments of FIG. 15, the catch 224 is closely adjacent the periphery of the lid such that it is easily reached by the user's thumb and flicked upwardly to break the tab 220 free and fold it back until the catch 224 fits into the recess 230.

The drink-through opening 226 is essentially formed in the highest portion of the annular outer deck 218 and does not extend through the lid rim. In a standard lid with a 1¾ inch radius, the hinge lies just under ⅝ inch inboard and the tab 224, when folded back, lies no more than about 1⅛ inch inboard from the lid rim.

I claim:

1. A plastic drink-through lid for an open top drink cup with a rim, said lid being of the type generally having a deck portion, an integral rim engaging skirt; the improvement comprising a preformed, at least partially separated, fold-back tab formed within the deck adjacent but spaced in its entirety from the skirt to create a drink-through opening in the deck when folded back; a preformed hinge in the deck extending along the interior edge of the tab; the hinge lying sufficiently close to the peripheral skirt that the tab, when folded back, lies entirely on one side of the lid center;

an upstanding thumb catch having inner and outer exterior surfaces formed integrally with the tab and extruding upwardly therefrom to a height which is higher than the deck, the lid being free of raised structural features between the skirt and the outer surface of the catch, a recess formed in the deck inwardly adjacent the hinge to receive the catch therein when the tab is folded back; and said outer surface having upper and lower portions, a horizontal ridge formed on the upper portion and extending radially outwardly beyond the lower portion to assist in the manual engagement of the catch and to retain the catch in the recess.

2. The lid of claim 1 wherein the lid is made of light gage, thermoformable plastic.

3. The lid of claim 2 wherein the deck is essentially flat.

4. The lid of claim 3 further including a second ridge formed on an upper portion of the recess to interact with the catch ridge to lock the thumb catch in the recess.

5. The lid of claim 3 wherein the lid is a plug fit lid defined by an annular groove formed in the deck adjacent the skirt.

6. A plastic drink-through lid for an open-ended, rimmed drink cup, sized to be held in the hand, said lid comprising: a peripheral skirt, an inner deck and a raised annular outer deck surrounding the inner deck and raised relative thereto, a fold-back tab formed within the raised outer deck closely adjacent but spaced from the skirt to create a drink-though opening; a raised catch formed in the tab and extending upwardly therefrom to a height greater than the height of the outer deck, the lid being free of raised structural features between the rim and a catch, a locking recess formed in the inner deck inwardly adjacent the hinge for receiving the raised catch; and a hinge formed directly between the tab and the recess, the hinge lying sufficiently close to the skirt such that the entirety of the tab lies on one side of the lid center when folded back; and said catch having an outer surface with upper and lower portions, a horizontal ridge formed on said upper portion and extending radially outwardly beyond the lower portion to assist in the manual engagement of the catch and to retain the catch in the recess.

7. The lid of claim 6, wherein the lid is made of light gage, thermoformable plastic.

* * * * *